US010870550B2

(12) United States Patent
Tokuda et al.

(10) Patent No.: US 10,870,550 B2
(45) Date of Patent: Dec. 22, 2020

(54) PRINTING APPARATUS

(71) Applicant: CANON KABUSHIKI KAISHA, Tokyo (JP)

(72) Inventors: Shuichi Tokuda, Kawasaki (JP); Seiji Ogasawara, Machida (JP); Takaaki Ishida, Kawasaki (JP); Masakazu Tsukuda, Yokohama (JP); Masaaki Matsuura, Kawasaki (JP); Kazuki Matsuo, Kawasaki (JP); Tomofumi Nishida, Kawasaki (JP); Yuna Hattori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 16/259,191

(22) Filed: Jan. 28, 2019

(65) Prior Publication Data

US 2019/0241383 A1 Aug. 8, 2019

(30) Foreign Application Priority Data

Feb. 8, 2018 (JP) ..... 2018-020899

(51) Int. Cl.
*B65H 7/12* (2006.01)
*B65H 5/06* (2006.01)
(Continued)

(52) U.S. Cl.
CPC ..... *B65H 7/12* (2013.01); *B41J 2/16505* (2013.01); *B41J 2/16588* (2013.01); *B41J 3/60* (2013.01);
(Continued)

(58) Field of Classification Search
CPC ..... B65H 5/062; B65H 5/068; B65H 7/06; B65H 7/12; B65H 7/18; B65H 2511/20;
(Continued)

(56) References Cited

U.S. PATENT DOCUMENTS 5,899,613 A 5/1999 Koike et al.
8,573,593 B2 11/2013 Shiraishi
(Continued)

FOREIGN PATENT DOCUMENTS

JP 2012-163848 A 8/2012

OTHER PUBLICATIONS

U.S. Appl. No. 16/220,871, Masaaki Matsurra Seiji Ogasawara Takaaki Ishida Masakazu Tsukuda Shuichi Tokuda Kazuki Matsuo, filed Dec. 14, 2018.
(Continued)

*Primary Examiner* — David H Bollinger
(74) *Attorney, Agent, or Firm* — Venable LLP

(57) ABSTRACT

In a printing apparatus, the ends of print media fed continuously can be prevented from colliding with each other. The printing apparatus includes a printing unit configured to perform a print operation, a detecting unit configured to detect a conveyance abnormality, a conveying unit configured to convey a preceding print medium and a succeeding print medium, a conveying path having a first area including a curved portion at which a conveying direction of the print medium is curved and a second area upstream of the first area, and an opening unit capable of opening the first area of the conveying path. In a case in which a leading edge of the succeeding print medium is located in the second area at the time of the detecting unit detecting conveyance abnormality of the preceding print medium, the conveying unit conveys the succeeding print medium so that the leading edge of the succeeding print medium reaches the first area.

14 Claims, 15 Drawing Sheets

(51) Int. Cl.

| | |
|---|---|
| ***B41J 2/165*** | (2006.01) |
| ***B41J 13/00*** | (2006.01) |
| ***B41J 3/60*** | (2006.01) |
| ***B41J 11/00*** | (2006.01) |

(52) U.S. Cl.
CPC ..... *B41J 11/006* (2013.01); *B41J 11/0095* (2013.01); *B41J 13/0009* (2013.01); *B65H 5/06* (2013.01); *B65H 2511/524* (2013.01); *B65H 2511/528* (2013.01)

(58) Field of Classification Search
CPC ..... B65H 2511/22; B65H 2511/224; B65H 2511/524; B65H 2511/528; B65H 2402/45; B65H 2402/441; B41J 2/16505; B41J 2/16588; B41J 3/60; B41J 11/006; B41J 11/0095; B41J 13/0009; B41J 13/03
See application file for complete search history.

(56) References Cited

U.S. PATENT DOCUMENTS

| | | | |
|---|---|---|---|
| 8,672,439 | B2 | 3/2014 | Suzuki et al. |
| 9,370,946 | B2 | 6/2016 | Nishida et al. |
| 9,388,010 | B2 | 7/2016 | Kunihiro et al. |
| 9,586,780 | B2 | 3/2017 | Nishida et al. |
| 2015/0256694 | A1 | 9/2015 | Suzuki et al. |
| 2017/0361631 | A1 | 12/2017 | Matsuura et al. |

OTHER PUBLICATIONS

U.S. Appl. No. 16/223,729 Masakazu Tsukuda Seiji Ogasawara Takaaki Ishida Shuichi Tokuda Masaaki Matsuura Kazuki Matsuo, filed Dec. 18, 2018.

U.S. Appl No. 16/270,950, Kazuki Matsuo Seiji Ogasawara Takaaki Ishida Shuichi Tokuda Masakazu Tsukuda Masaaki Matsuura, filed Feb. 8, 2019.

PRINTING APPARATUS

BACKGROUND OF THE INVENTION

Field of the Invention

The present invention relates to a printing apparatus.

Description of the Related Art

The printing apparatus described in Japanese Patent Laid-Open No. 2012-163848 performs forcedly moving processing to forcedly move a print medium at rest on the deep side of the apparatus to a removal work area in the case of detecting conveyance abnormality, such as a jam. After execution of the forcedly moving processing, a user rectifies the error of conveyance abnormality by exposing the removal work area by opening an open/close cover and removing the print medium moved to the removal work area.

SUMMARY OF THE INVENTION

However, in Japanese Patent Laid-Open No. 2012-163848, for the purpose of preventing the ends of print media fed continuously from colliding with each other within the conveying path, the forcedly moving processing is not performed for the subsequent print medium depending on the position of the preceding print medium. In this case, it is possible for a user to remove the preceding print medium that is stuck within the removal work area exposed by opening the open/close cover, but not possible to remove the subsequent print medium that has not reached the removal work area. Consequently, it is necessary for a user to remove the subsequent print medium by opening another open/close cover, cassette, and so on. As described above, Japanese Patent Laid-Open No. 2012-163848 has such a problem that it is not possible to efficiently rectify the error of conveyance abnormality.

Consequently, in view of the above-described problem, an object of the present invention is to prevent the ends of print media fed continuously from colliding with each other within the conveying path even in the case where the subsequent print medium is moved to the removal work area irrespective of the position of the preceding print medium.

The present invention is a printing apparatus having: a printing unit configured to perform print operation for a print medium; a detecting unit configured to detect conveyance abnormality of a print medium; a conveying unit configured to convey a preceding print medium and a succeeding print medium; a conveying path having a first area including a curved portion at which a conveying direction of the print medium is curved and a second area upstream of the first area in the conveying direction; and an opening unit capable of opening the first area of the conveying path, wherein, in a case where a leading edge of the succeeding print medium is located in the second area at the time of the detecting unit detecting conveyance abnormality of the preceding print medium, the conveying unit conveys the succeeding print medium so that the leading edge of the succeeding print medium reaches the first area.

Further features of the present invention will become apparent from the following description of exemplary embodiments with reference to the attached drawings.

DESCRIPTION OF THE EMBODIMENTS

Figure 1:
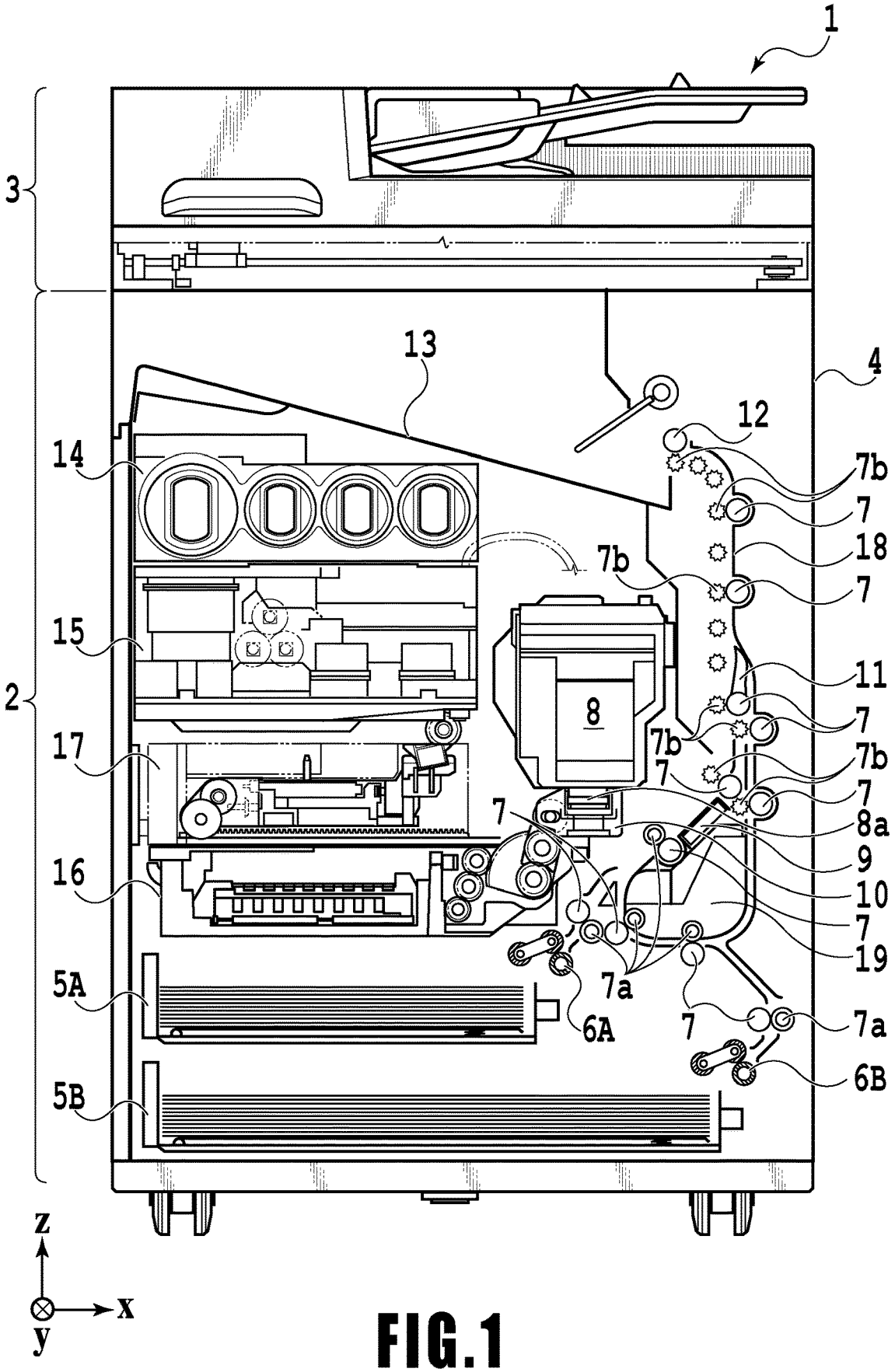
FIG. 1 is a diagram in the case where a printing apparatus is in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to the paper) is a direction in which ejection openings are arrayed in a print head 8 (described later), and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing media (cut sheets) S are detachably provided at the bottom of a casing 4 in the vertical direction. Relatively small printing media of up to A4 size are stacked and housed in the first cassette 5A and relatively large printing media of up to A3 size are stacked and housed in the second cassette 5B. A first feeding unit 6A for feeding housed printing media one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding the print medium S in a predetermined direction. The conveying rollers 7 are drive rollers located upstream and downstream of the print head 8 (platen 9) and driven by a conveying motor. The pinch rollers 7*a* are follower rollers that are turned while nipping the print medium S together with the conveying rollers 7. The discharging roller 12 is a drive roller located downstream of the conveying rollers 7 and driven by the discharging motor. The spurs 7*b* nip and convey the print medium S together with the conveying rollers 7 and discharging roller 12 located downstream of the print head 8 (platen 9).

The printing apparatus 1 is provided with a plurality of motors for driving the above-described drive rollers and each of the above-described drive rollers is connected to one of the plurality of motors. A correspondence relationship between the motors and the drive rollers will be explained later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing media S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of the print medium S. In the case where the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 (described later) such that the ejection opening surface 8*a* faces the platen 9. The platen 9 includes a flat plate extending in the y-direction and supports the print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
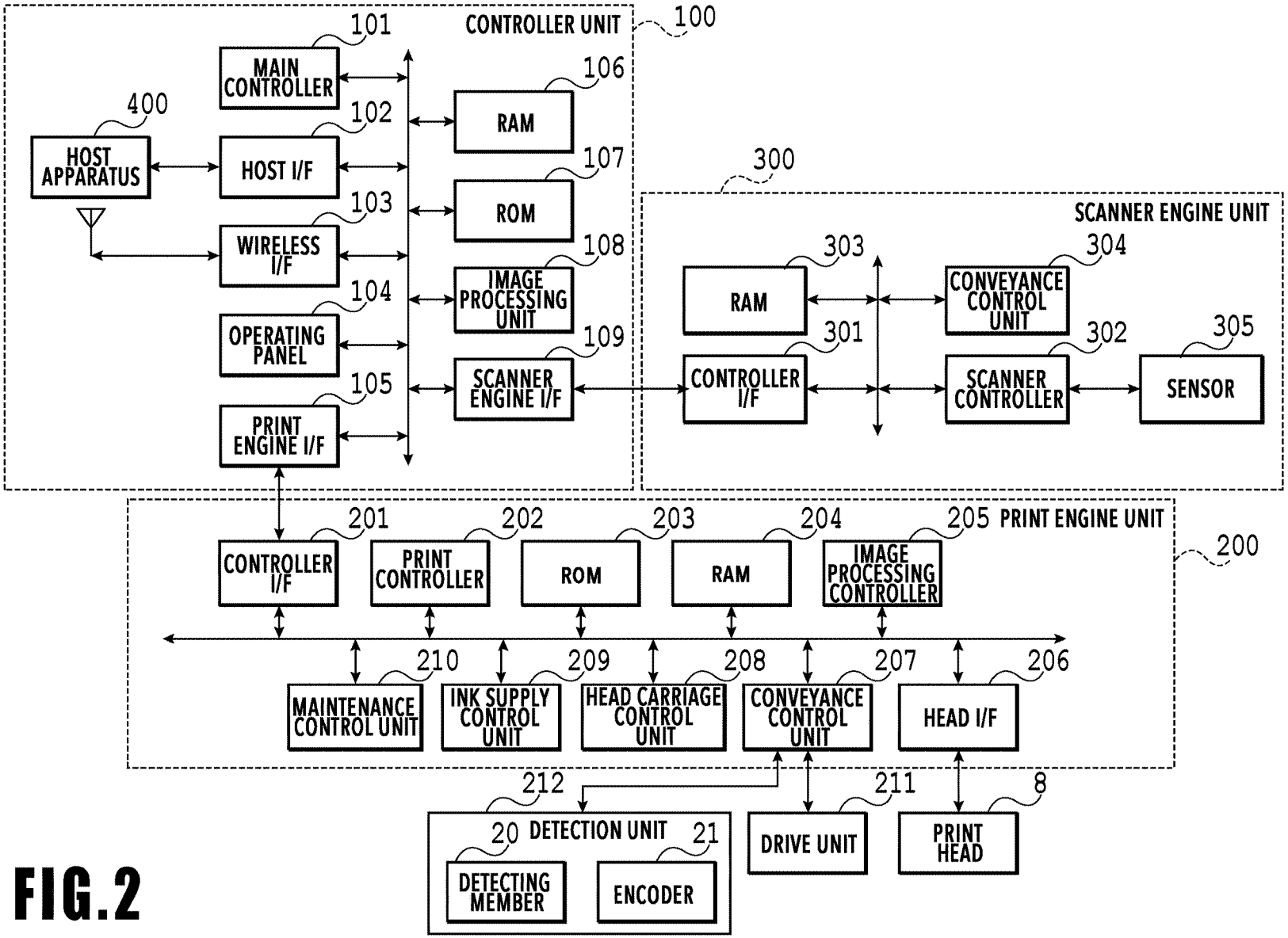
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to perform input and output for the printing apparatus 1. A user can give an instruction to perform operations such as copying and scanning, can set a print mode, and can recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207.

The conveyance control unit 207 is connected to a detecting unit 212 configured to detect a conveying state of the print medium S and a drive unit 211 configured to drive a plurality of drive rollers and control the conveyance of the print medium S by using the drive unit 211 based on the detection results obtained from the detecting unit 212. The detecting unit 212 has a detecting member 20 that detects the presence/absence of the print medium S and an encoder 21 that detects a drive roller turning amount.

In the process in which the print medium S is conveyed by the conveyance control unit 207, the print operation by the print head 8 is performed and image forming processing is performed under instructions of the print controller 202.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
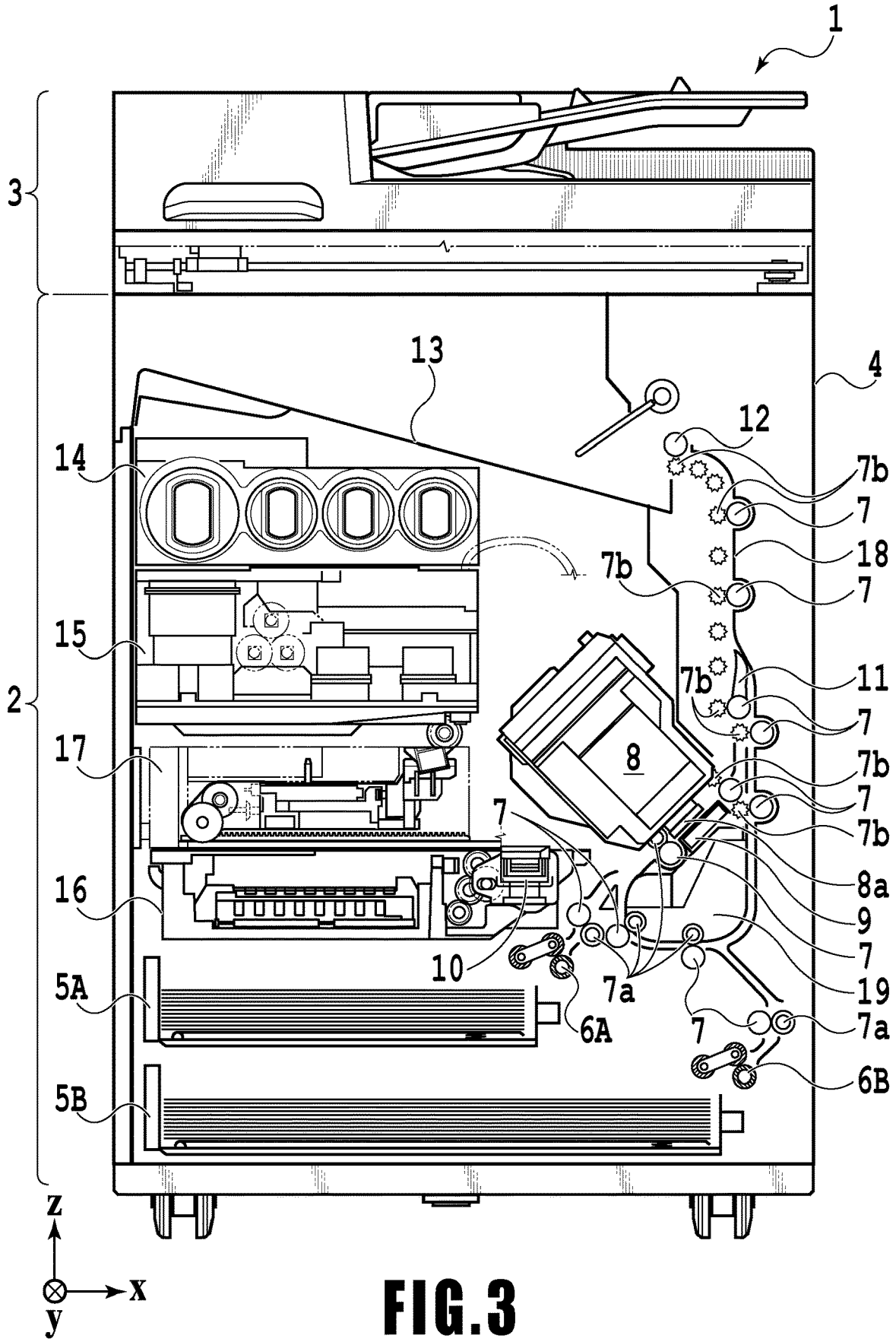
FIG. 3 is a diagram in the case where the printing apparatus is in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
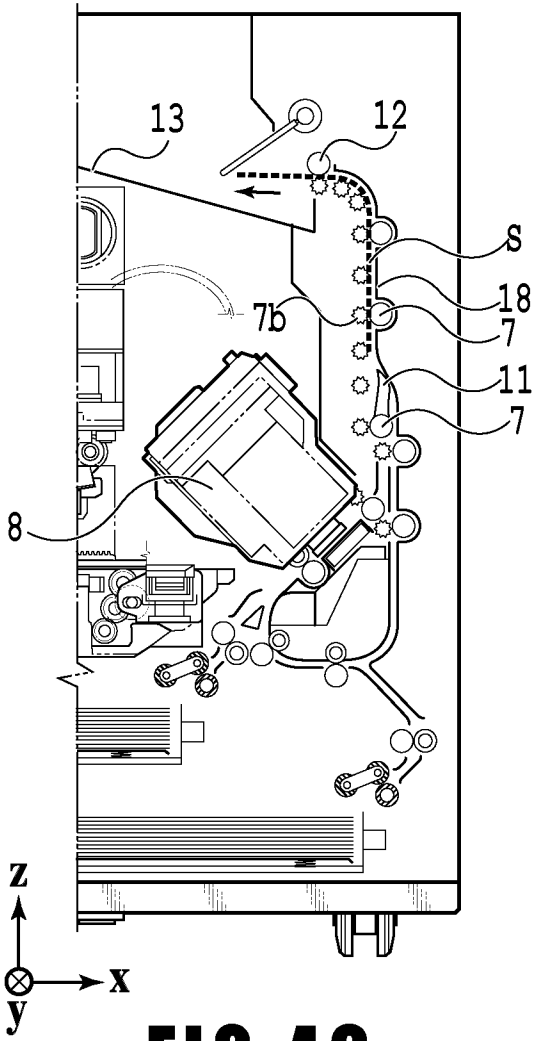
FIG. 4A to FIG. 4C are each a conveying path diagram of a print medium fed from a first cassette.
Figure 4B:
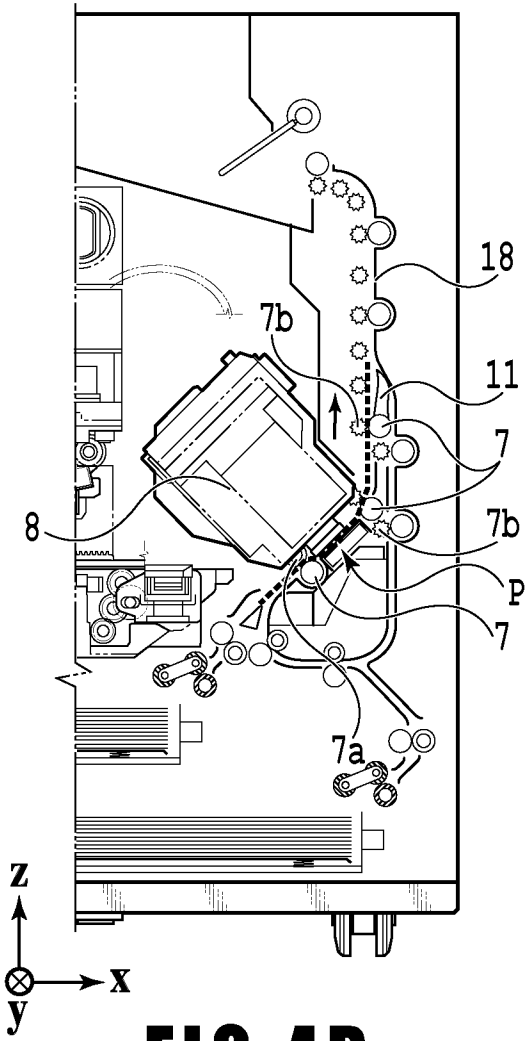
Figure 4A:
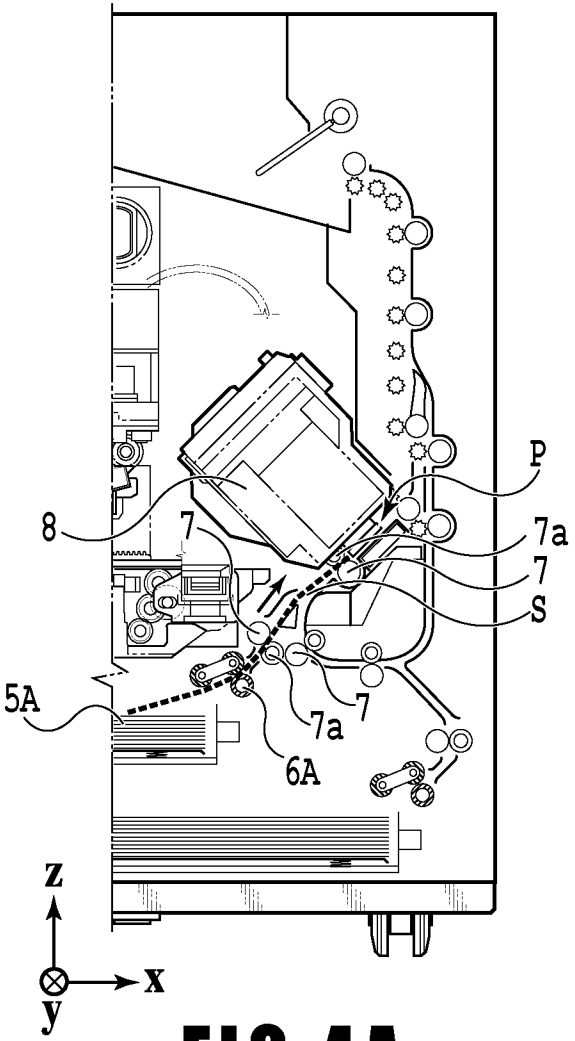

FIGS. 4A to 4C are diagrams showing a conveying path in the case of feeding an A4 size print medium S from the first cassette 5A. A print medium S at the top of a stack of printing media in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the leading edge of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the leading edge of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the leading edge of the print medium S has passed through the discharging roller 12 and the print medium S is being discharged into the discharging tray 13. The discharged print medium S is held in the discharging tray 13 with the side on which an image was printed by the print head 8 down.

Figure 5C:
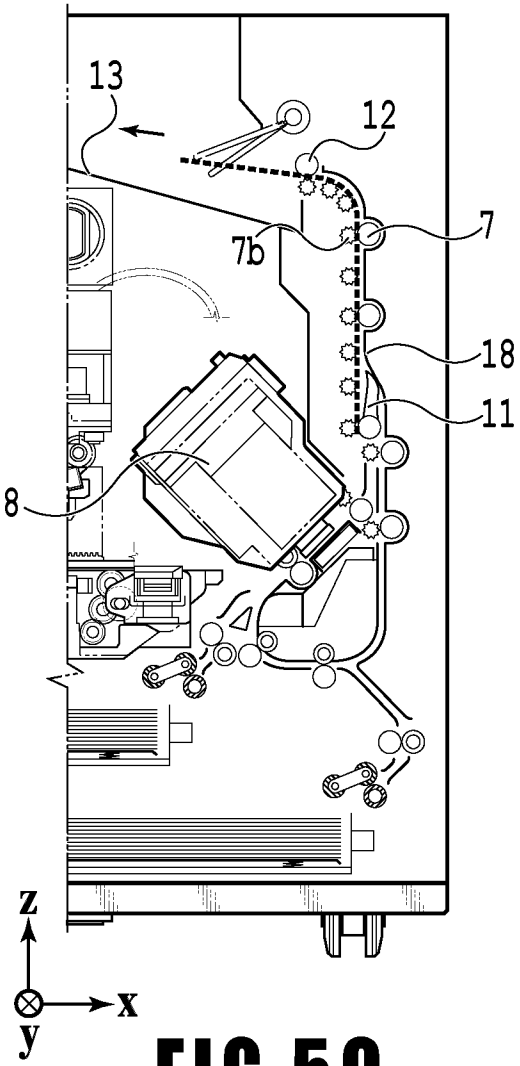
FIG. 5A to FIG. 5C are each a conveying path diagram of a print medium fed from a second cassette.
Figure 5B:
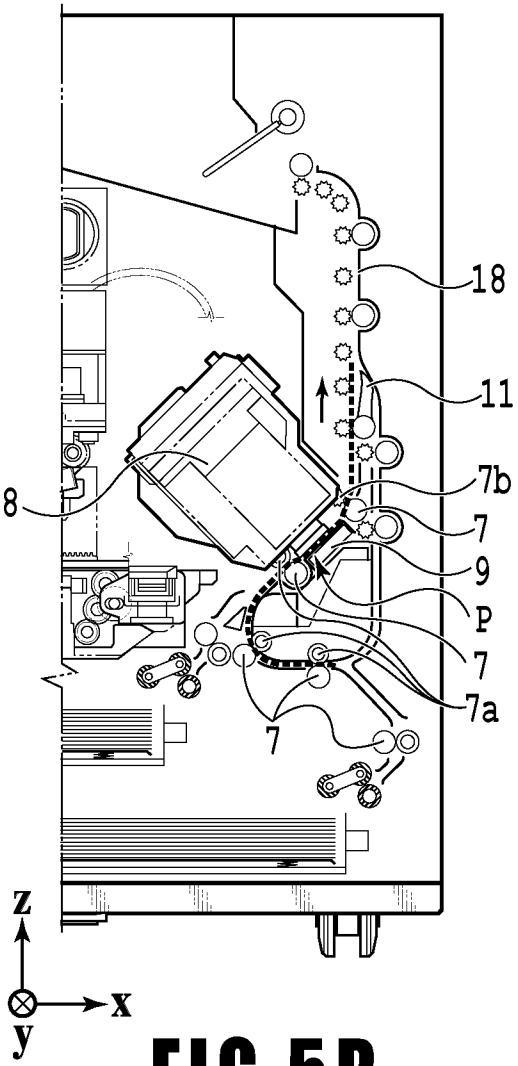
Figure 5A:
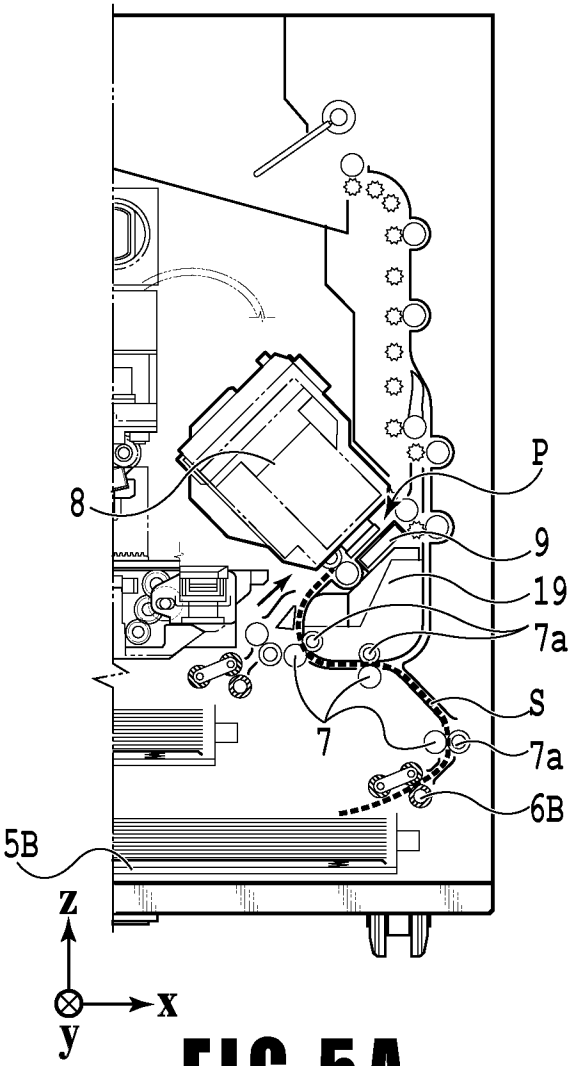

FIGS. 5A to 5C are diagrams showing a conveying path in the case of feeding an A3 size print medium S from the second cassette 5B. A print medium S at the top of a stack of printing media in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the leading edge of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the leading edge of the print medium S has passed through the print area P and the print medium S is being conveyed vertically upward. FIG. 5C shows a state where the leading edge of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
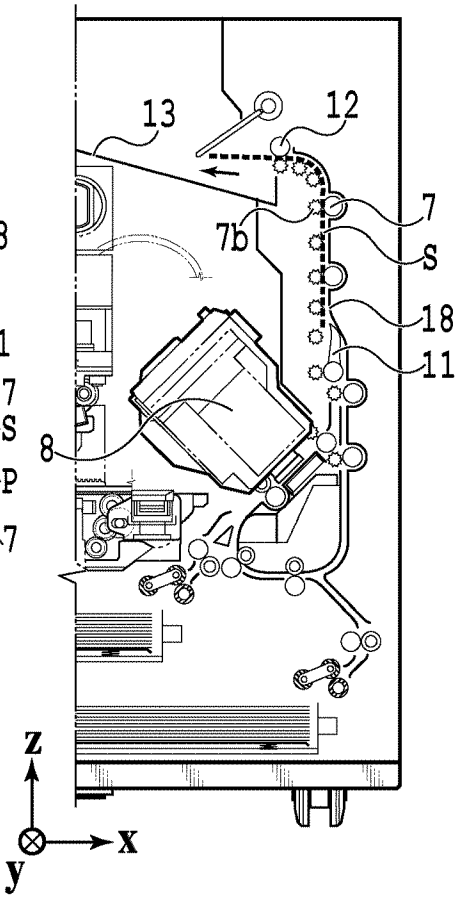
FIG. 6A to FIG. 6D are each a conveying path diagram in the case where print operation is performed on the back side of a print medium.
Figure 6C:
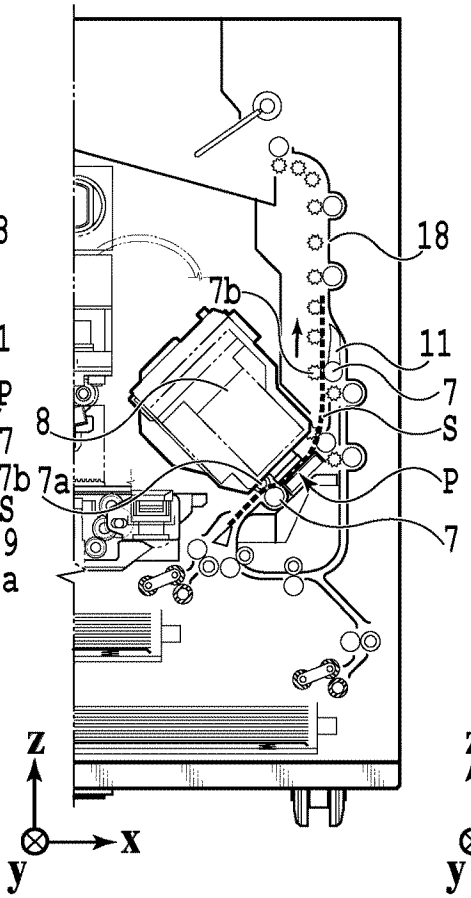
Figure 6B:
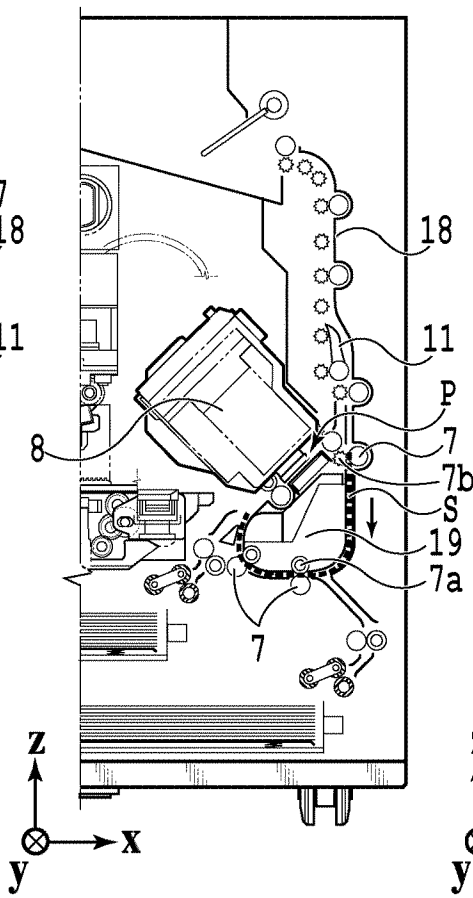
Figure 6A:
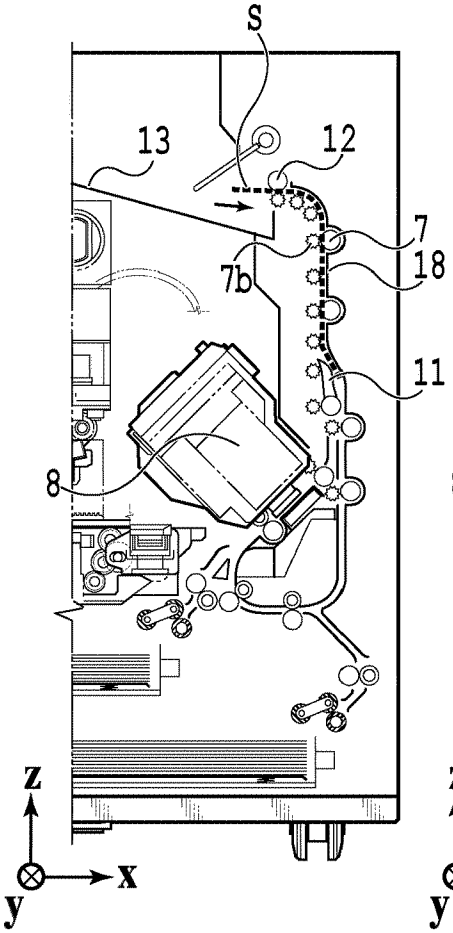

After the print head 8 finishes print operation for the first side and the trailing edge of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the leading edge of the print medium S (corresponding to the trailing edge during the print operation for the first side) passes on the right of the flapper 11 and is conveyed vertically downward. FIG. 6A shows a state where the leading edge of the print medium S (corresponding to the trailing edge during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the leading edge of the print medium S is about to reach the print area P for print operation for the second side.

The rest of the conveying path is the same as that in the case of the print operation for the first side shown in FIGS. 4B and 4C. FIG. 6C shows a state where the leading edge of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the leading edge of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
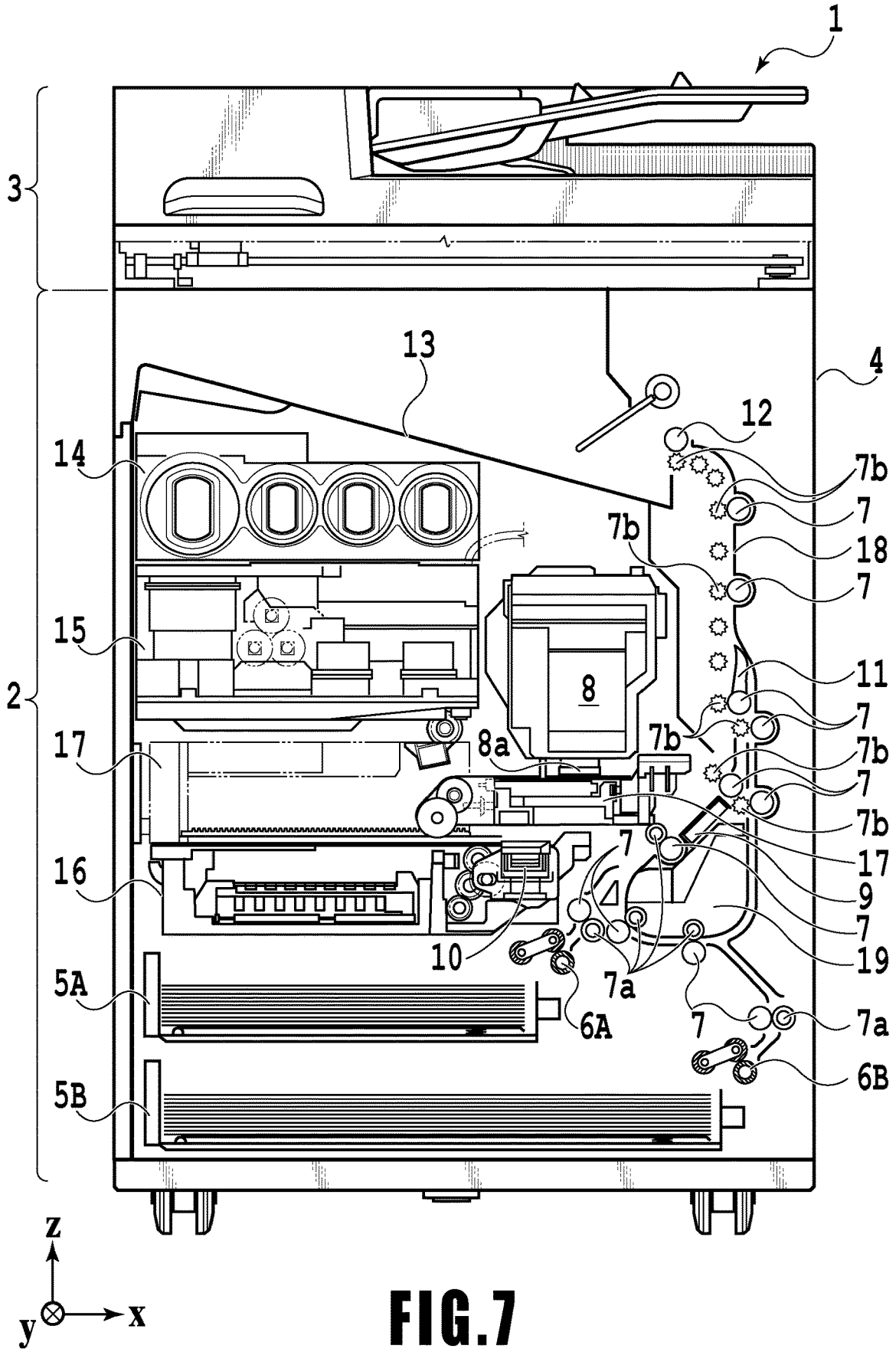
FIG. 7 is a diagram in the case where the printing apparatus is in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
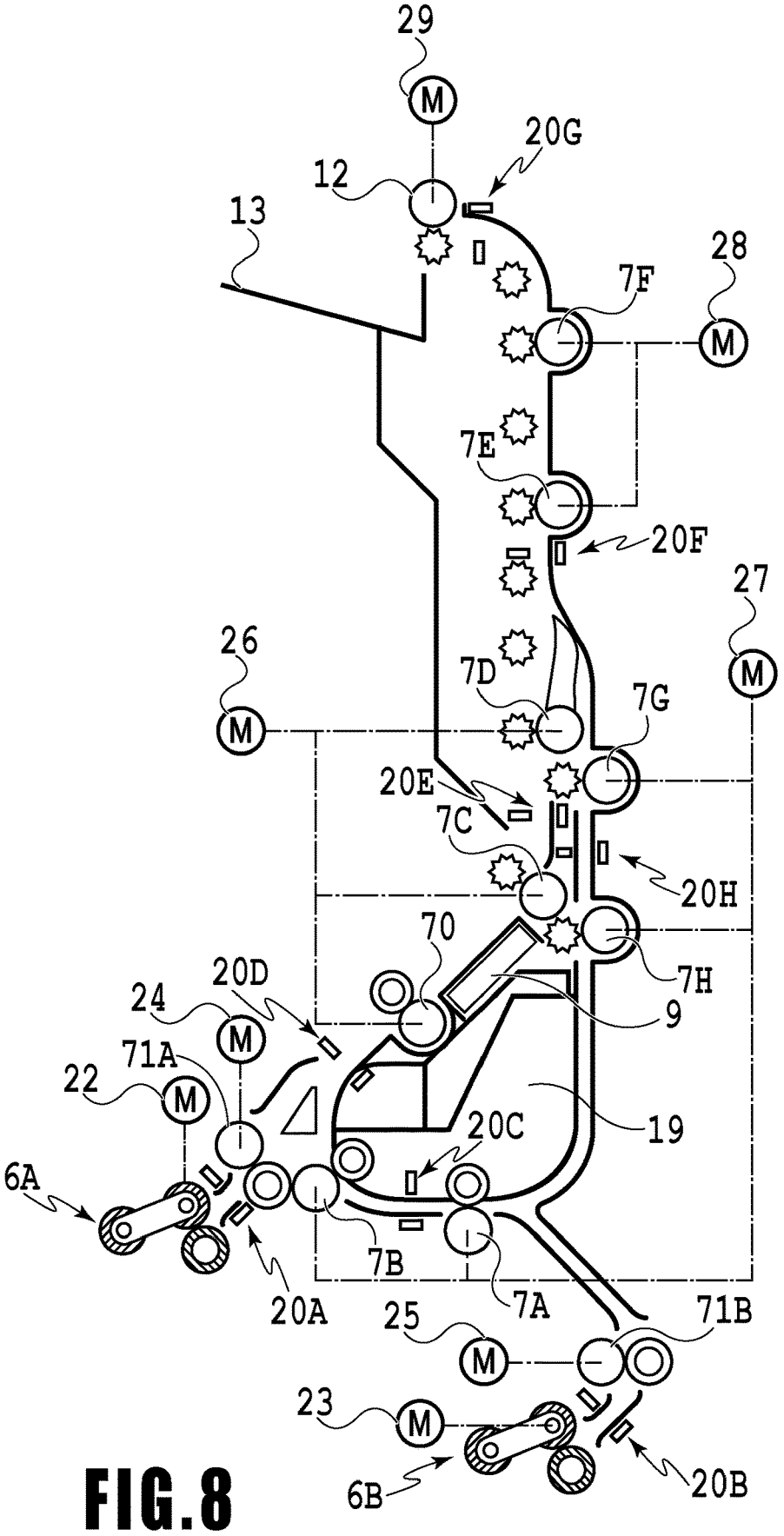
FIG. 8 is a diagram showing a correspondence relationship between drive rollers and motors.

FIG. 8 is a diagram showing a correspondence relationship between a plurality of motors and a plurality of drive rollers in the printing apparatus 1. A first feeding motor 22 drives the first feeding unit 6A for feeding the print medium S from the first cassette 5A. A second feeding motor 23 drives the second feeding unit 6B for feeding the print medium S from the second cassette 5B. A first conveying motor 24 drives a first middle roller 71A that first conveys the print medium fed by the first feeding unit 6A. A second conveying motor 25 drives a second middle roller 71B that first conveys the print medium S fed by the second feeding unit 6B.

A main conveying motor 26 drives a main conveying roller 70 that is arranged upstream of the platen 9 and mainly conveys the print medium S being printed. Further, the main conveying motor 26 drives two conveying rollers 7C and 7D that are arranged downstream of the platen 9 and further convey the print medium S conveyed by the main conveying roller 70 downstream.

A third conveying motor 27 drives two conveying rollers 7G and 7H that convey the print medium S for the first side of which printing has been performed downward. Further, the third conveying motor 27 drives two conveying rollers 7A and 7B that convey the print medium S that is fed from the second cassette 5B and conveyed by the second middle roller 71B, or the print medium S for the first side of which printing has been performed and whose first and second sides are inverted toward the print head 8.

A fourth conveying motor 28 drives two conveying rollers 7E and 7F that convey the print medium S after print operation has been performed upward or downward. A discharging motor 29 drives the discharging roller 12 that discharges the print medium S for which printing has been performed into the discharging tray 13. As described above, each of the two feeding motors 22 and 23, the five conveying motors 24 to 28, and the discharging motor 29 is associated with one or more rollers.

On the other hand, at eight portions along the conveying path, detecting members 20A to 20H for detecting the presence/absence of the print medium S are arranged. Each detecting member includes a sensor and a mirror arranged with the conveying path being sandwiched in between, and the sensor having a light emitting unit and a light receiving unit is arranged on one side of the conveying path and the mirror is arranged at the position on the opposite side of the conveying path and in opposition to the sensor. Light emitted from the light emitting unit of the sensor is reflected from the mirror and by whether or not the light receiving unit detects this, the presence/absence of the print medium S, that is, the passage of the leading edge or the trailing edge is determined.

The conveyance control unit 207 drives the feeding motors 22 and 23, the conveying motors 24 to 28, and the discharging motor 29 individually and controls the conveyance of the entire apparatus based the detection result of each of the plurality of detecting members 20A to 20H and the output value of the encoder that detects the turning amount of each drive roller.

First Embodiment

<About Configuration of Printing Apparatus>

Figure 9A:
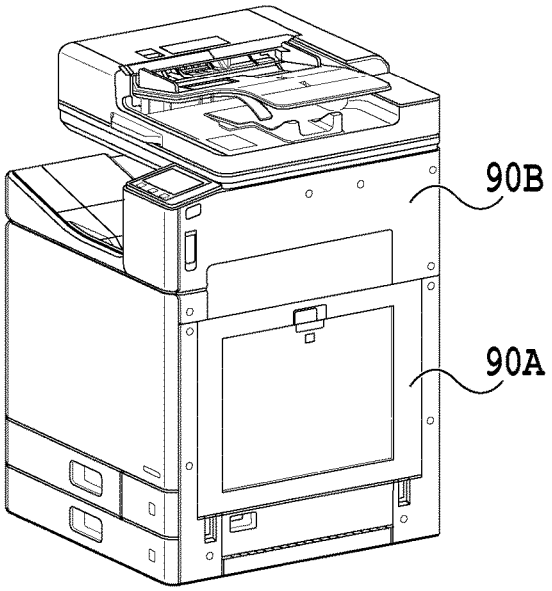
FIG. 9A to FIG. 9D are each a diagram showing a state transition at the time of exposing the deep side of a removal work area in a first embodiment.

In the following, the configuration of the printing apparatus 1 in the present embodiment is explained by using FIG. 9A to FIG. 9D. FIG. 9A is a perspective diagram showing the configuration of the printing apparatus 1 in the present embodiment. As shown in FIG. 9A, the printing apparatus 1 in the present embodiment includes a first cover 90A and a second cover 90B, in addition to the components described above by using FIG. 1 to FIG. 3 and the like. In the case where a print medium is stuck within the conveying path due to the occurrence of conveyance abnormality of a print medium, such as a jam (paper jam), it becomes necessary for a user to remove the print medium from the conveying path by opening the cover or the cassette corresponding to the position at which the print medium is stuck.

Figure 9B:
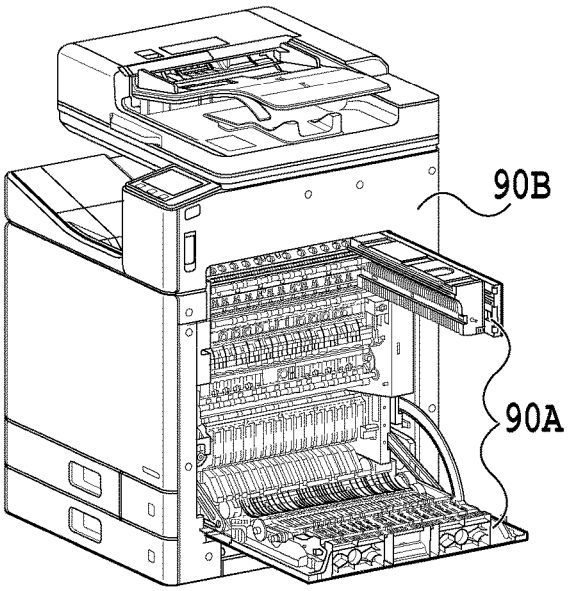
Figure 9C:
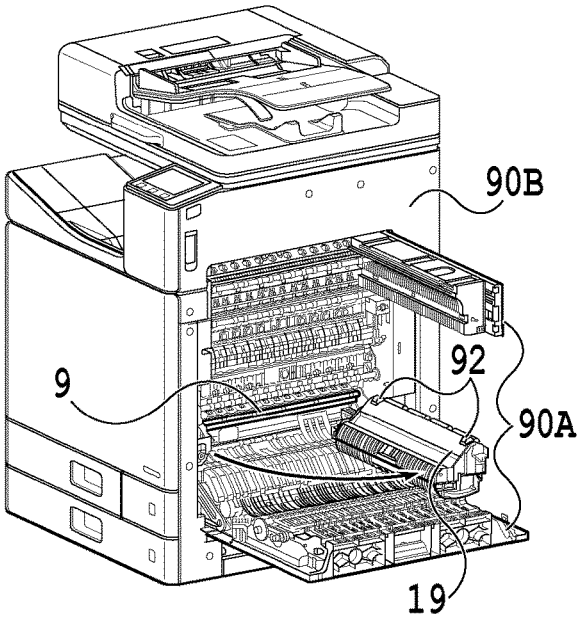

FIG. 9B is a diagram showing the printing apparatus 1 in the case where the first cover 90A is opened. FIG. 9C is a diagram showing the printing apparatus 1 in the case where the inner guide 19 is drawn out from the state shown in FIG. 9B. On the top and at both end portions in the lengthwise direction of the inner guide 19, a platen biasing member 92 for biasing the platen 9 is provided. In the state where the inner guide 19 is housed in the printing apparatus 1, the position of the platen 9 is determined by the platen biasing member 92. In the case where a user turns and draws out the inner guide 19 in accordance with an arrow in FIG. 9C, the biasing force for the platen 9 by the platen biasing member 92 disappears. As a result of this, the position of the platen 9 shifts as shown in FIG. 9C and the state is brought about where a user can turn the platen 9 downward.

Figure 9D:
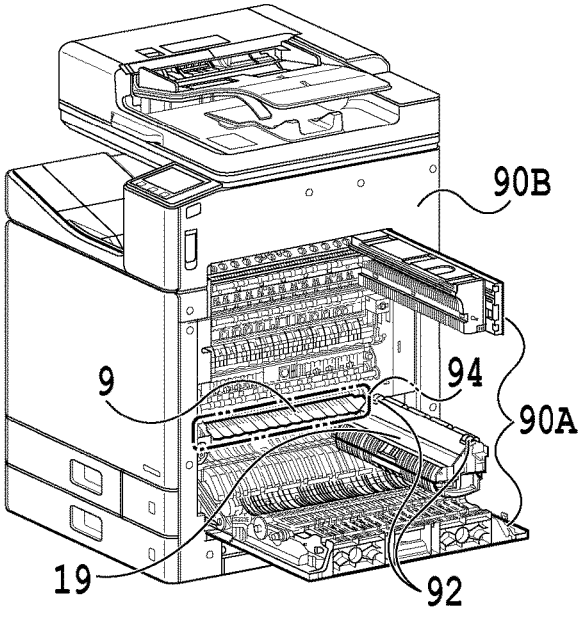

FIG. 9D is a diagram showing the printing apparatus 1 in the case where a user turns the platen 9 downward from the state shown in FIG. 9C. By a user turning the platen 9 downward, in FIG. 9D, a removal work area 94 indicated by a two-dot chain line is exposed until the deep side thereof appears. The removal work area 94 is an area in which a user performs the work to remove a print medium from the printing apparatus 1 and a user puts his/her hand into the removal work area 94 and removes a stuck print medium.

<About Structure Around Removal Work Area>

Figure 10A:
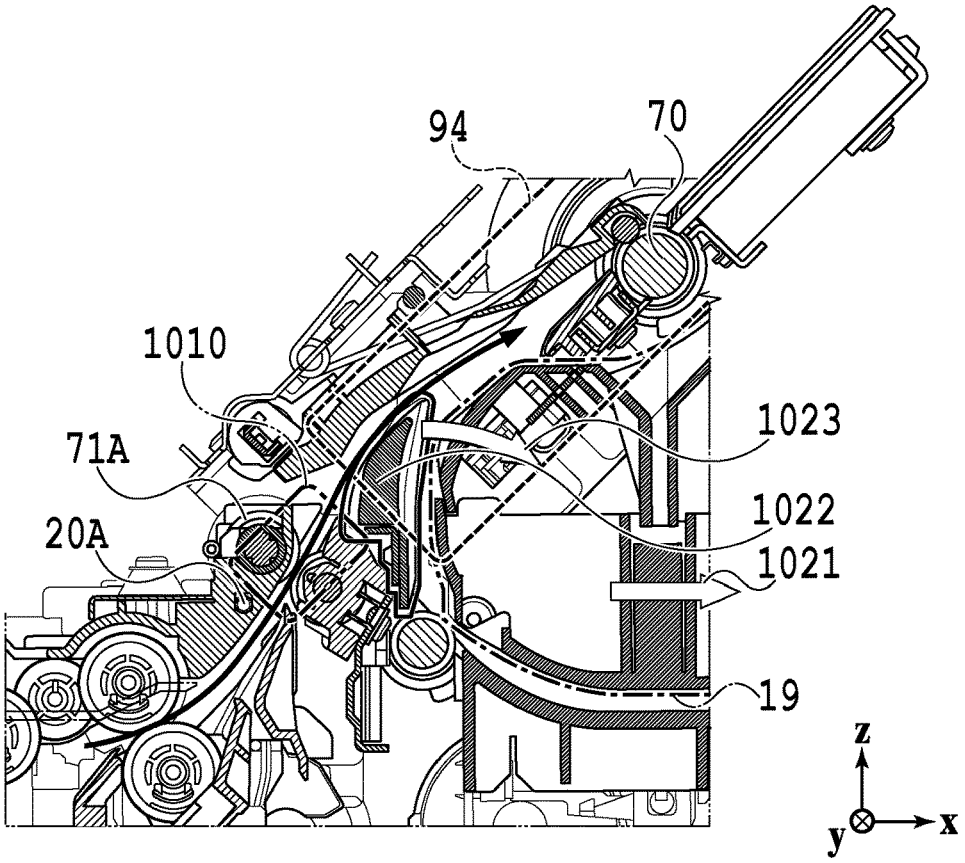
FIG. 10A and FIG. 10B are each a sectional diagram showing a structure around the removal work area in the first embodiment.
Figure 10B:
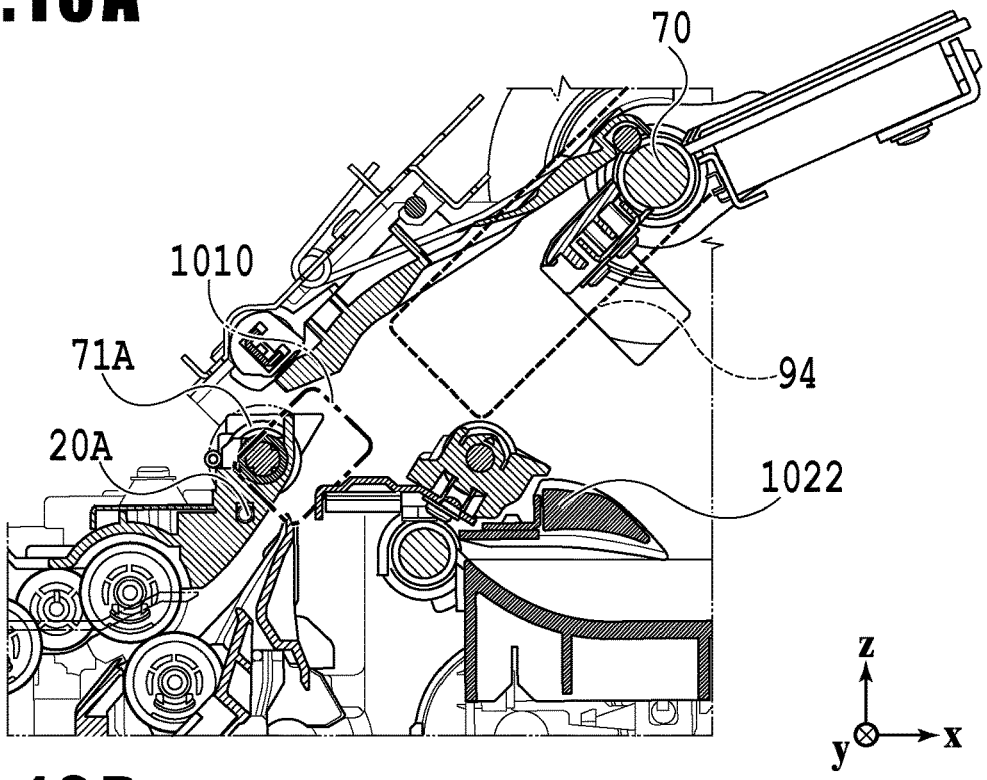

In the following, the structure around the removal work area in the present embodiment is explained by using FIG. 10A and FIG. 10B. FIG. 10A and FIG. 10B are each a sectional diagram showing a detailed structure around the removal work area 94 in the present embodiment, and FIG. 10A shows a state before a user draws out the inner guide 19 and FIG. 10B shows a state after a user draws out the inner guide 19.

The removal work area 94 indicated by the broken line in FIG. 10A is provided by making use of the curved outer surface of the inner guide 19 indicated by the one-dot chain line so as to include the area of the conveying path between the first middle roller 71A and the main conveying roller 70 whose slopes of the nip tangents are different from each other. The nip tangent refers to the tangent of the roller that passes through the nip portion between the roller and the pinch roller that follows the roller. As described above, the conveying path includes the curved portion at which the conveying direction of the print medium is curved and the removal work area 94 is provided so as to include the curved portion and this is an important feature of the present embodiment. It is only required for the acute angle (taken to be θ) formed by the nip tangent of the first middle roller 71A and the nip tangent of the main conveying roller 70 to be any one value in the range not smaller than 0 degrees and smaller than the angle (about 45 degrees) between the horizontal plane and the plane of the platen 9.

As explained by using FIG. 9A to FIG. 9D, a user opens the first cover 90A and draws out the inner guide 19 in the direction of an arrow 1021. Further, by the inner guide 19 moving as described above, a second guide 1022 indicated by the solid line moves in the direction of a thick line arrow 1023 in FIG. 10. Due to this, as shown in FIG. 10B, by the inner guide 19 moving, a space is formed under the platen 9, and therefore, it is made possible for a user to turn the platen 9 downward. After drawing out the inner guide 19, a user turns the platen 9 downward and exposes the deep side area of the conveying path. By doing this, it is made possible to easily remove the print medium that is stuck on the deep side of the printing apparatus 1. Further, by the second guide 1022 also turning downward, a space upstream of the main conveying roller 70 is opened, and therefore, it is made possible for a user to access the entire area of the removal work area 94.

Further, as shown in FIG. 10A and FIG. 10B, a forcedly moved area 1010 exists upstream of the removal work area 94. In the case where the leading edge of the print medium existing in a predetermined area in the vicinity of the first middle roller 71A has not reached the removal work area 94 at the time of the occurrence of conveyance abnormality of the print medium, the printing apparatus 1 forcedly moves the print medium until the print medium reaches the removal work area 94. This processing to forcedly move the print medium is called forcedly moving processing. The forcedly moved area 1010 refers to the predetermined area in the vicinity of the first middle roller 71A described above.

<About a Series of Operations for Discharging a Print Medium from a Conveying Path in the Case where Conveyance Abnormality of a Print Medium is Detected>

Figure 11:
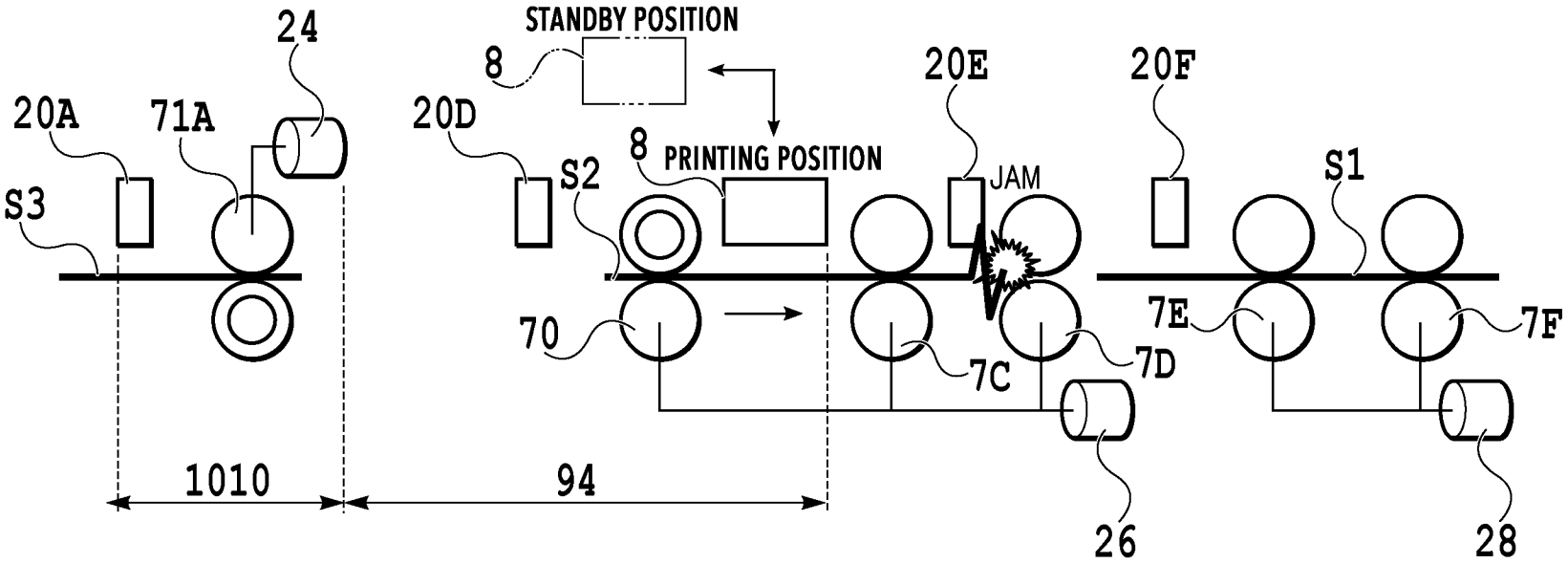
FIG. 11 is a diagram showing a series of operations for discharging a print medium from a conveying path in the case where conveyance abnormality of a print medium is detected.

FIG. 11 is a diagram schematically showing the operation in the case where conveyance abnormality of a print medium is detected in the printing apparatus 1, and specifically, showing a case where print media S1 to S3 fed from the first cassette 5A exist within the conveying path and the print medium S2 is stuck in the vicinity of the conveying roller 7D. In FIG. 11, in order to make understanding easy, the conveying path is straight, but in fact, the conveying path is formed so that at least part thereof is curved and the conveying direction of a print medium becomes curved.

In the case shown in FIG. 11, by the detecting member 20F and the encoder 21 (see FIG. 2) connected to the conveying roller 7D, the conveyance abnormality of the print medium S2 is detected. In the case where this conveyance abnormality is detected, the print operation by the print head 8 for the print medium S2 is immediately suspended and the print head 8 is moved from the printing position up to the standby position. The standby position is a position evacuated from the printing position and a position at which it is possible to, for example, protect the ejection opening surface 8*a* of the print head 8.

Further, the drive of the main conveying motor 26 that turns the main conveying roller 70 and the conveying rollers 7C and 7D conveying the print medium S2 is suspended. On the other hand, by continuing the drive of the fourth conveying motor 28 that turns the conveying rollers 7E and 7F conveying the print medium S1 downstream of the print medium S2, and the discharging motor 29 (see FIG. 8), the print medium S1 is discharged to the outside of the printing apparatus 1 (into the discharging tray 13). After the completion of discharge operation of the print medium S1, the drive of the fourth conveying motor 28 and the discharging motor 29 is suspended.

Further, the drive of the first conveying motor 24 that turns the first middle roller 71A conveying the print medium S3 and the first feeding motor 22 (see FIG. 8) that turns the roller of the first feeding unit 6A is temporarily suspended. The leading edge of the print medium S3 exists within the area of the forcedly moved area 1010, and therefore, the forcedly moving processing to forcedly move the print medium S3 up to the removal work area 94 is performed. In the present embodiment, the forcedly moved area 1010 is the area from the position that faces the detecting member 20A to the position a predetermined distance from the first middle roller 71A. In the case where the print medium S3 is moved by the forcedly moving processing, the leading edge of the print medium S3 reaches the removal work area 94. In the case shown in FIG. 11, the print medium S3 does not exist in the removal work area 94 in the state immediately after the conveyance abnormality occurs, but the subsequent forcedly moving processing causes the trailing edge of the print medium S2 and the leading edge of the print medium S3 to exist in the removal work area 94.

After the completion of the forcedly moving processing, the printing apparatus 1 gives a notification to cause a user to perform the work for rectifying the error of conveyance abnormality via the operating panel 104. At this time, it may also be possible to display the position at which the conveyance abnormality has occurred and the contents relating to the cover, the slot and so on to be opened (in the case of this example, instructions to open the first cover 90A) on the operating panel 104.

After that, a user opens the first cover 90A to draw out the inner guide 19 and then exposes the deep side area of the conveying path (see FIG. 9A to FIG. 9D). Then, a user rectifies the error of conveyance abnormality by putting his/her hand into the removal work area 94 and removing the stuck print media S2 and S3. As described above, by sending the leading edge or the trailing edge of the print medium existing on the deep side of the printing apparatus 1 in the state immediately after the occurrence of conveyance abnormality into the removal work area 94 by the forcedly moving processing, it is made possible for a user to easily remove the print media from the conveying path. The forcedly moving processing will be described later in detail by using FIG. 12A, FIG. 12B, FIG. 13 and so on.

<About Position Relationship after Forcedly Moving Processing Between Print Media Fed Continuously>

Figure 12A:
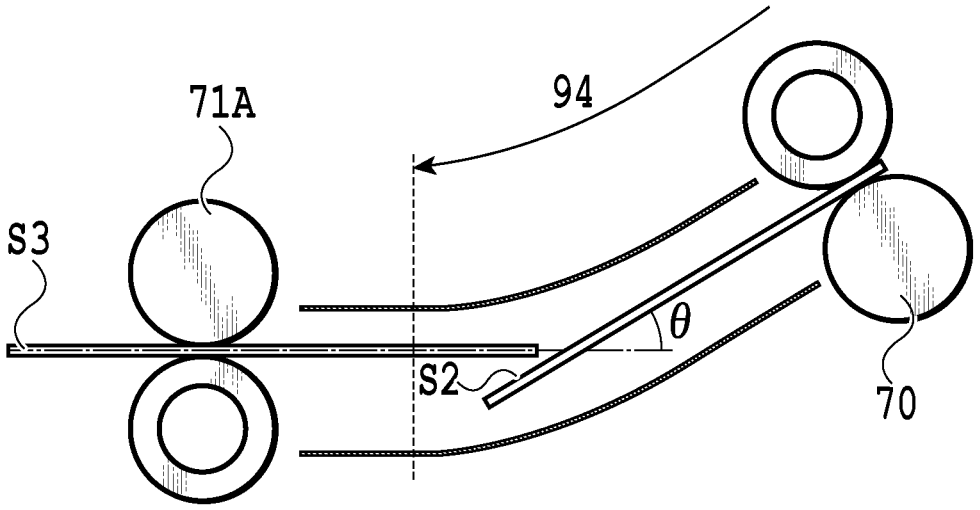
FIG. 12A and FIG. 12B are each a diagram showing a position relationship between print media after forcedly moving processing.
Figure 12B:
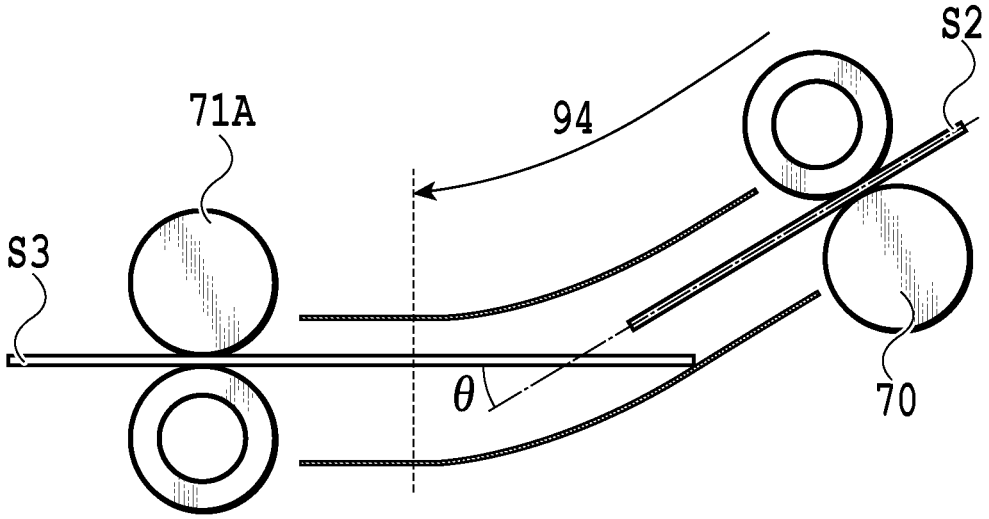

FIG. 12A and FIG. 12B are each a diagram showing a position relationship between the print medium S2 and the print medium S3 in the removal work area 94 in the case where the print medium S2 jams in the vicinity of the conveying roller 7D and the forcedly moving processing is performed for the print medium S3 that follows the print medium S2 as shown FIG. 11. In FIG. 12A and FIG. 12B, of the removal work area 94, in particular, the vicinity of the first middle roller 71A and the main conveying roller 70 is shown.

As described above, the removal work area 94 includes the area (curved portion) of the conveying path between the first middle roller 71A and the main conveying roller 70 whose slopes of the nip tangents are different from each other. By causing the conveying path to include the curved portion such as above, in the case where the preceding print medium (S2) is stuck within the removal work area 94, the trailing edge of the preceding print medium and the leading edge of the subsequent print medium are suppressed from colliding with each other even though the subsequent print medium (S3) is sent into the removal work area 94. Consequently, it is possible to prevent the print media from becoming harder to take out because these print media collide with each other within the conveying path and bend due to the forcedly moving processing.

Figure 15:
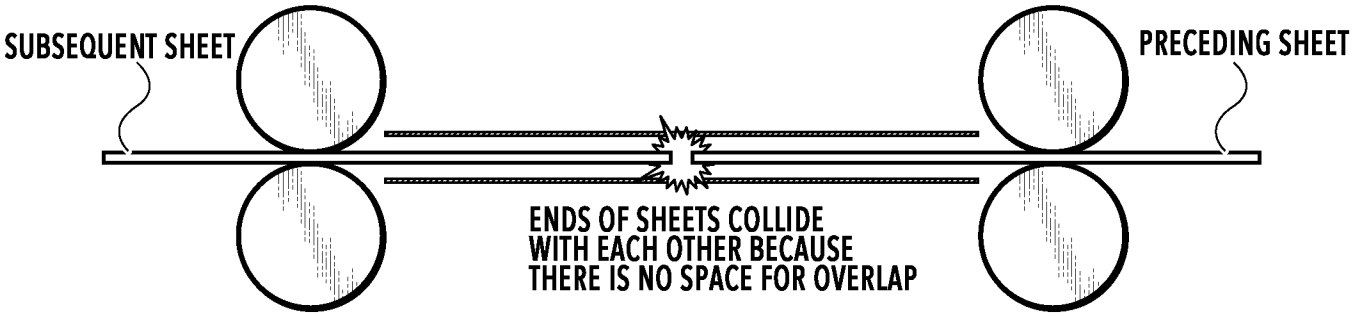
FIG. 15 is a diagram explaining a problem of the present invention.

In the following, specific explanation is given. FIG. 12A shows the case where the subsequent print medium S3 is sent into the removal work area 94 in the state where the preceding print medium S2 is stuck within the removal work area 94, and as a result of this, the leading edge of the print medium S3 overlaps the trailing edge of the print medium S2 from above. On the other hand, FIG. 12B shows the case where the subsequent print medium S3 is sent into the removal work area 94 in the state where the print medium S2 is stuck within the removal work area 94, and as a result of this, the leading edge of the print medium S3 overlaps the trailing edge of the print medium S2 from below. As above, in the case where the subsequent print medium is sent into the removal work area 94 in the state where the preceding print medium is stuck within the removal work area 94, the subsequent print medium overlaps the preceding print medium from above or from below because the conveying path is curved. For a comparison, an example of the case where the conveying path is formed as a straight line is shown in FIG. 15. In the case where the conveying path is formed as a straight line, there is no space in which the subsequent print medium and the preceding print medium overlap, and therefore, the end portions of the print media may collide with each other and bend. By curving the conveying path sandwiched by the upstream roller pair and the downstream roller pair as in the present embodiment, it is possible for the printing apparatus 1 to perform the forcedly moving processing to send the subsequent print medium into the removal work area 94 irrespective of the presence/absence of a preceding print medium. In the case where the forcedly moving processing such as this is performed, it is made possible for a user to remove the two print media S2 and S3 by opening the first cover 90A to draw out the platen biasing member 92, and therefore, it is possible to rectify conveyance abnormality efficiently.

<About Forcedly Moving Processing of Print Medium>

Figure 13:
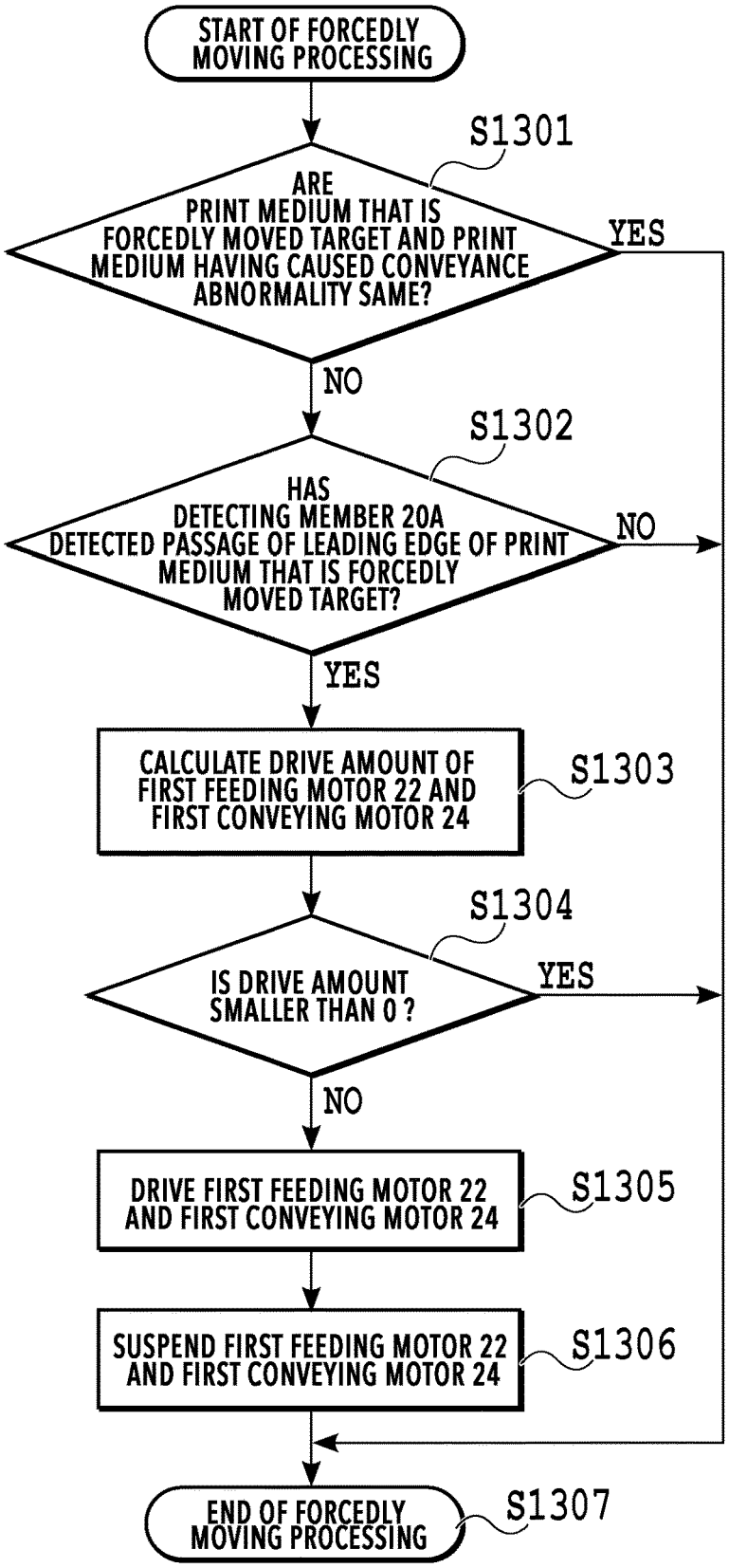
FIG. 13 is a flowchart of the forcedly moving processing in the first embodiment.

In the following, the forcedly moving processing of a print medium in the present embodiment is explained by using FIG. 13 by taking the case as an example where a print medium fed from the first cassette 5A exists within the conveying path.

At step S1301, the conveyance control unit 207 determines whether the print medium that is the forcedly moved target and the print medium that has caused conveyance abnormality are the same. In the case of the present embodiment, the print media having a possibility of being moved forcedly are the print media being conveyed by the rollers upstream of the main conveying roller 70, specifically, the print media being conveyed by the roller of the first feeding unit 6A and the first middle roller 71A. Consequently, at this step, the conveyance control unit 207 determines whether the print medium that has caused conveyance abnormality is the print medium being conveyed by those rollers upstream of the main conveying roller 70. This determination is performed based on the output of the encoder connected to the first feeding unit 6A, the output of the detecting member 20A, the output of the encoder connected to the first middle roller 71A, and the output of the detecting member 20D. In the case where the determination results at this step are affirmative, the series of processing is terminated without forcedly moving the print medium. On the other hand, in the case where the determination results at this step are negative, the processing advances to step S1302.

At step S1302, the conveyance control unit 207 determines whether the detecting member 20A has detected the passage of the leading edge of the print medium that is the forcedly moved target. In the case where the determination results at this step are affirmative, the processing advances to step S1303. On the other hand, in the case where the determination results at this step are negative, the series of processing is terminated without forcedly moving the print medium. In this case, a user removes the print medium that follows the print medium having caused conveyance abnormality by opening the first cassette 5A, not by opening the first cover 90A to remove the print medium from the removal work area 94.

At step S1303, the conveyance control unit 207 calculates an amount by which the first feeding motor 22 and the first conveying motor 24 are driven (referred to as a drive amount). A calculation method of a drive amount will be described later in detail by using FIG. 14.

At step S1304, the conveyance control unit 207 determines whether the drive amount calculated at step S1303 is smaller than 0. In the case where the determination results at this step are affirmative, the series of processings is terminated without forcedly moving the print medium. The case where the calculated drive amount is smaller than 0 means that the leading edge of the print medium that is the forcedly moved target is already located within the removal work area 94 and corresponds to the case where it is not necessary to forcedly convey the print medium by the first middle roller 71A. On the other hand, in the case where the determination results at this step are negative, the processing advances to step S1305.

At step S1305, the conveyance control unit 207 moves the print medium by starting to turn the first middle roller 71A by driving the first conveying motor 24 as well as starting to turn the roller of the first feeding unit 6A by driving the first feeding motor 22. That is, the conveyance control unit 207 performs the forcedly moving processing of the print medium that is the forcedly moved target. Then, the conveyance control unit 207 drives the first feeding motor 22 and the first conveying motor 24 by the drive amount calculated at step S1303.

At step S1306, the conveyance control unit 207 suspends the turning of the roller of the first feeding unit 6A and the first middle roller 71A by suspending the first feeding motor 22 and the first conveying motor 24. Due to this, the movement of the print medium that is the forcedly moved target is terminated.

The above describes the contents of the forcedly moving processing of a print medium in the present embodiment.

<About Calculation Method of Drive Amount>

Figure 14:
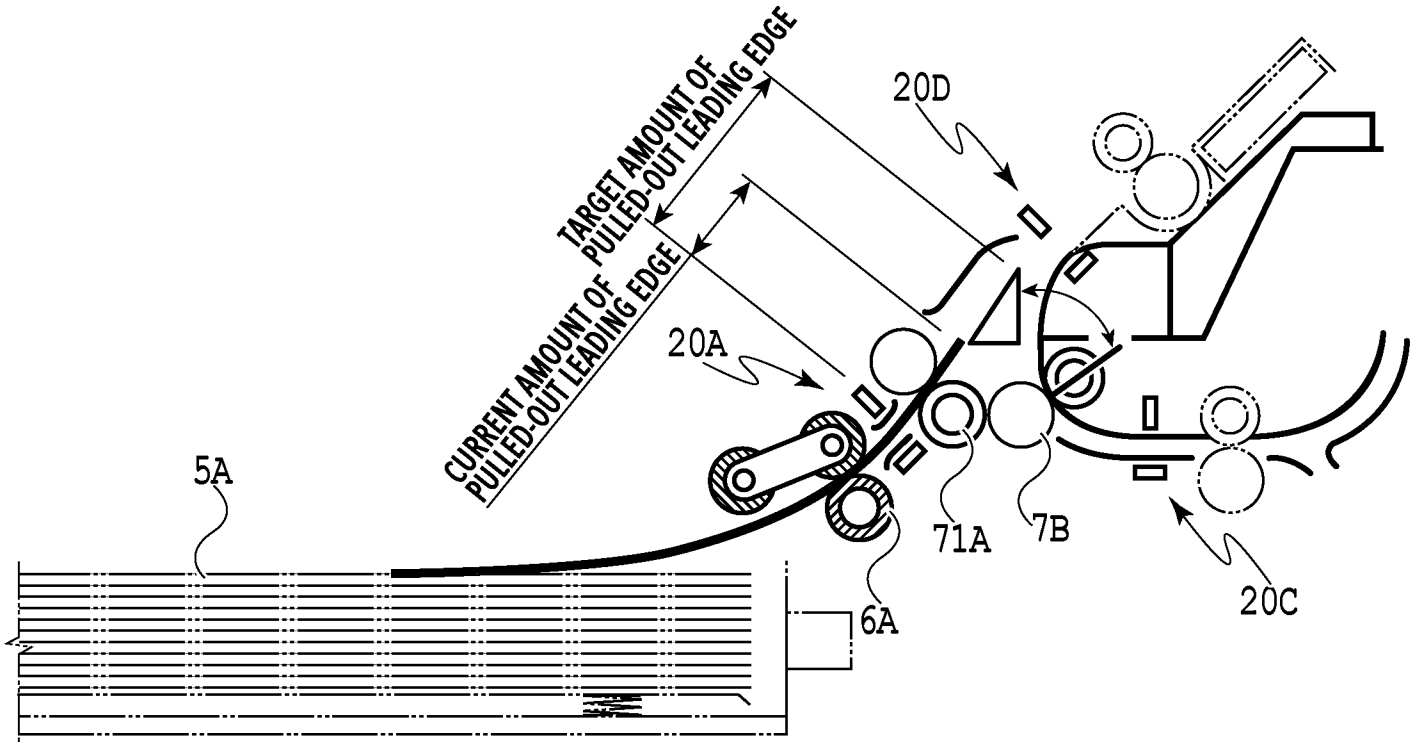
FIG. 14 is a diagram showing a calculation method of a motor drive amount.

In the following, the calculation method of a motor drive amount at step S1303 described above is explained by using FIG. 14. FIG. 14 is a diagram showing the printing apparatus 1 at the time of performing the forcedly moving processing.

In the state shown in FIG. 14, the conveyance control unit 207 calculates an amount indicating how far the leading edge of the print medium that is the forcedly moved target is located downstream from the position of the detecting member 20A (referred to as a current amount of pulled-out leading edge). The current amount of pulled-out leading edge is calculated based on a roller turning amount of the first feeding unit 6A during the period of time from the passage of the leading edge of the print medium that is the forcedly moved target at the position of the detecting member 20A until the occurrence of conveyance abnormality. Here, it is assumed that the current amount of pulled-out leading edge is 3.00 mm.

Next, the conveyance control unit 207 calculates the distance of movement (referred to as a forcedly moving amount) of the print medium by subtracting the current amount of pulled-out leading edge from a target amount of pulled-out leading edge. Here, the target amount of pulled-out leading edge [mm] is an amount indicating a distance by which the leading edge of the print medium is separated finally from the position of the detecting member 20A by the forcedly moving processing. That is, an amount by which the leading edge of the print medium is sent into the removal work area 94 so that it is easy for a user to remove the print medium from the removal work area 94. It may also be possible for a designer of the printing apparatus 1 to set any value as the forcedly moving amount. Further, it may also be possible for the printing apparatus 1 to have in advance information on the motor drive amount (referred to as the maximum drive amount), which corresponds to the target amount of pulled-out leading edge. Here, it is assumed that the target amount of pulled-out leading edge is 21.44 mm. In this case, the forcedly moving amount is 18.44 (=21.44-3.00) mm.

Next, the conveyance control unit 207 calculates the motor drive amount based on the forcedly moving amount calculated above. In the case of this example, the forcedly moving amount is 18.44 mm, and therefore, as the motor drive amount, a value corresponding to the roller turning amount necessary for moving the print medium 18.44 mm is calculated.

The above is the calculation method of a drive amount in the present embodiment.

<About Effect, Modification Example and so on of the Present Embodiment>

As described above, the removal work area 94 is provided so as to include the area of the conveying path in which the conveying direction of a print medium is curved (specifically, the area of the conveying path between the two rollers whose slopes of the nip tangents are different from each other). Then, irrespective of whether or not the preceding print medium is stuck within the removal work area 94 having the configuration such as this, the forcedly moving processing for the subsequent print medium is performed and the print medium is sent into the removal work area 94. At this time, even in the case where the preceding print medium is stuck within the removal work area 94, the ends of the preceding print medium and the subsequent print medium do not collide with each other (FIG. 15).

Consequently, in the case where the preceding print medium is stuck within the removal work area 94, by the forcedly moving processing, not only the preceding print medium but also the print medium that follows are caused to exist within the removal work area 94. Because of this, it is possible for a user to efficiently remove those print media from the removal work area 94 that is exposed by opening the first cover 90A.

The printing apparatus to which the present invention can be applied is not limited only to the inkjet printing apparatus and it is possible to apply the present invention to a printing apparatus that performs printing on the print medium S by various systems. Further, the printing apparatus to which the present invention can be applied is not limited only to the so-called full line type inkjet printing apparatus as in the above-described embodiment and for example, it is also possible to apply the present invention to a serial scan inkjet printing apparatus.

Furthermore, the arrangement positions of detecting members and the correspondence relationship between drive rollers and motors are not limited to the above-described embodiment and it may also be possible to appropriately change them in accordance with the shape and the like of the conveying path.

In the above-described embodiment, the detecting unit 212 detects conveyance abnormality based on the information on timings of detection by the detecting member 20 and the number of slits (drive roller turning amount) detected by the encoder corresponding to the detecting member 20, but this is not limited. That is, it is possible for the detecting unit 212 to adopt any configuration as long as the configuration can detect conveyance abnormality of the print medium S that is conveyed and can specify the leading edge position of a print medium, and to use various publicly known techniques. It may also be possible to include the configuration for detecting conveyance abnormality separately from the configuration for specifying the leading edge position of a print medium.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

By the present invention, even in the case where a subsequent print medium is moved into a removal work area irrespective of the position of a preceding print medium, it is unlikely that the ends of the print media fed continuously collide with each other within a conveying path.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-020899 filed Feb. 8, 2018, which is hereby incorporated by reference herein in its entirety.

What is claimed is:

1. A printing apparatus comprising:

a printing unit configured to perform a print operation for a print medium;

a detecting unit configured to detect a conveyance abnormality of a print medium;

a conveying unit configured to convey a preceding print medium and a succeeding print medium;

a conveying path having a curved portion in a conveying direction of the print medium and an upstream area upstream of the curved portion with respect to the conveying direction; and an opening unit capable of opening the curved portion of the conveying path, wherein, in a case in which a leading edge of the succeeding print medium is located in the upstream area at the time of the detecting unit detecting a conveyance abnormality of the preceding print medium, the conveying unit conveys the succeeding print medium so that the leading edge of the succeeding print medium reaches the curved portion.

2. The printing apparatus according to claim 1, wherein the conveying unit has a first conveying roller pair and a second conveying roller pair provided downstream of the first conveying roller pair in the conveying direction, wherein inclination of nip tangents of the first conveying roller pair and the second conveying roller pair are different from each other, and the curved portion is provided between the first conveying roller pair and the second conveying roller pair.

3. The printing apparatus according to claim 2, further comprising:

a second detecting unit provided upstream of the second conveying roller pair with respect to the conveying direction and configured to detect a leading edge and a trailing edge of a print medium, wherein based on detection results of the second detecting unit, an amount by which the succeeding print medium is conveyed up to the curved portion is determined.

4. The printing apparatus according to claim 3, further comprising:

a calculating unit configured to calculate a drive amount by which the conveying unit is driven in a case in which the leading edge of the succeeding print medium is detected by the second detecting unit.

5. The printing apparatus according to claim 2, wherein the first conveying roller pair and the second conveying roller pair are provided upstream of the printing unit with respect to the conveying direction in a case of performing the print operation.

6. The printing apparatus according to claim 1, wherein in a case in which the leading edge of the succeeding print medium is located in the upstream area at the time of the detecting unit detecting the conveyance abnormality of the preceding print medium, the conveying unit conveys the succeeding print medium so that the leading edge of the succeeding print medium reaches the curved portion irrespective of the position of the preceding print medium.

7. The printing apparatus according to claim 1, wherein the opening unit is a guide member provided so as to be turnable relative to the printing apparatus and forming part of the conveying path.

8. The printing apparatus according to claim 1, wherein the printing unit is a print head that ejects ink.

9. The printing apparatus according to claim 8, wherein the print head is of a full line type in which ejection openings that eject ink are arrayed so as to correspond to a width of a print medium conveyed by the conveying unit.

10. The printing apparatus according to claim 9, further comprising:

a cap that caps an ejection opening surface provided with the ejection openings, wherein the print head is movable between a printing position for the print operation and a cap position at which the print head is capped by the cap.

11. The printing apparatus according to claim 10, wherein the print head rotates between the printing position and the cap position.

12. The printing apparatus according to claim 1, wherein in the curved portion, the print medium is conveyed while being curved.

13. The printing apparatus according to claim 1, wherein in a case in which the conveyance abnormality is detected, the curved portion is opened and exposed by the opening unit.

14. A method of controlling a printing apparatus that comprises a printing unit configured to perform a print operation for a print medium, a detecting unit configured to detect a conveyance abnormality of a print medium, a conveying unit configured to convey a preceding print medium and a succeeding print medium, a conveying path having a curved portion in a conveying direction of the print medium and an upstream area upstream of the curved portion with respect to the conveying direction, and an opening unit capable of opening the curved portion of the conveying path, the method comprising:

in a case in which a leading edge of the succeeding print medium is located in the upstream area at the time of the detecting unit detecting a conveyance abnormality of the preceding print medium, conveying the succeeding print medium by the conveying unit so that the leading edge of the succeeding print medium reaches the curved portion.

* * * * *